United States Patent [19]

O'Neill

[11] 4,344,792

[45] Aug. 17, 1982

[54] REDUCTION SMELTING PROCESS

[75] Inventor: Charles E. O'Neill, Mississauga, Canada

[73] Assignee: Inco Ltd., Toronto, Canada

[21] Appl. No.: 238,585

[22] Filed: Feb. 26, 1981

[30] Foreign Application Priority Data

Feb. 28, 1980 [CA] Canada ..... 346622

[51] Int. Cl.[3] ..... C22B 1/10; C22B 1/11; C22B 5/08

[52] U.S. Cl. ..... 75/9; 75/3; 75/23; 75/26; 75/73; 75/75; 75/82

[58] Field of Search ..... 75/3–9, 75/23, 31, 73, 75, 82

[56] References Cited

U.S. PATENT DOCUMENTS 3,198,602 8/1965 Wittmann ..... 75/9
3,649,244 3/1972 Cunningham ..... 75/5
3,900,310 8/1975 Kaasila et al. ..... 75/23
4,266,971 5/1981 Schwartz et al. ..... 75/23

FOREIGN PATENT DOCUMENTS 757081 9/1956 United Kingdom ..... 75/23

*Primary Examiner*—Michael L. Lewis
*Attorney, Agent, or Firm*—Raymond J. Kenny; Ewan C. MacQueen

[57] ABSTRACT

A process for recovering metal values from sulfide ores or concentrates by a fluid bed roast-reduction smelting-converting process which delivers to the reduction smelting furnace either a blend of dead roasted concentrate and green concentrate or a partially roasted concentrate, either feed mixed with a carbonaceous reductant and silica flux, and either feed containing only sufficient sulfur to produce a matte, in which the iron is present as metallic iron, and which has a sulfur deficiency of about 0% to about 25% with respect to base metals, and which is later converted to a low iron matte by blowing and slagging the iron with silica flux.

9 Claims, 1 Drawing Figure

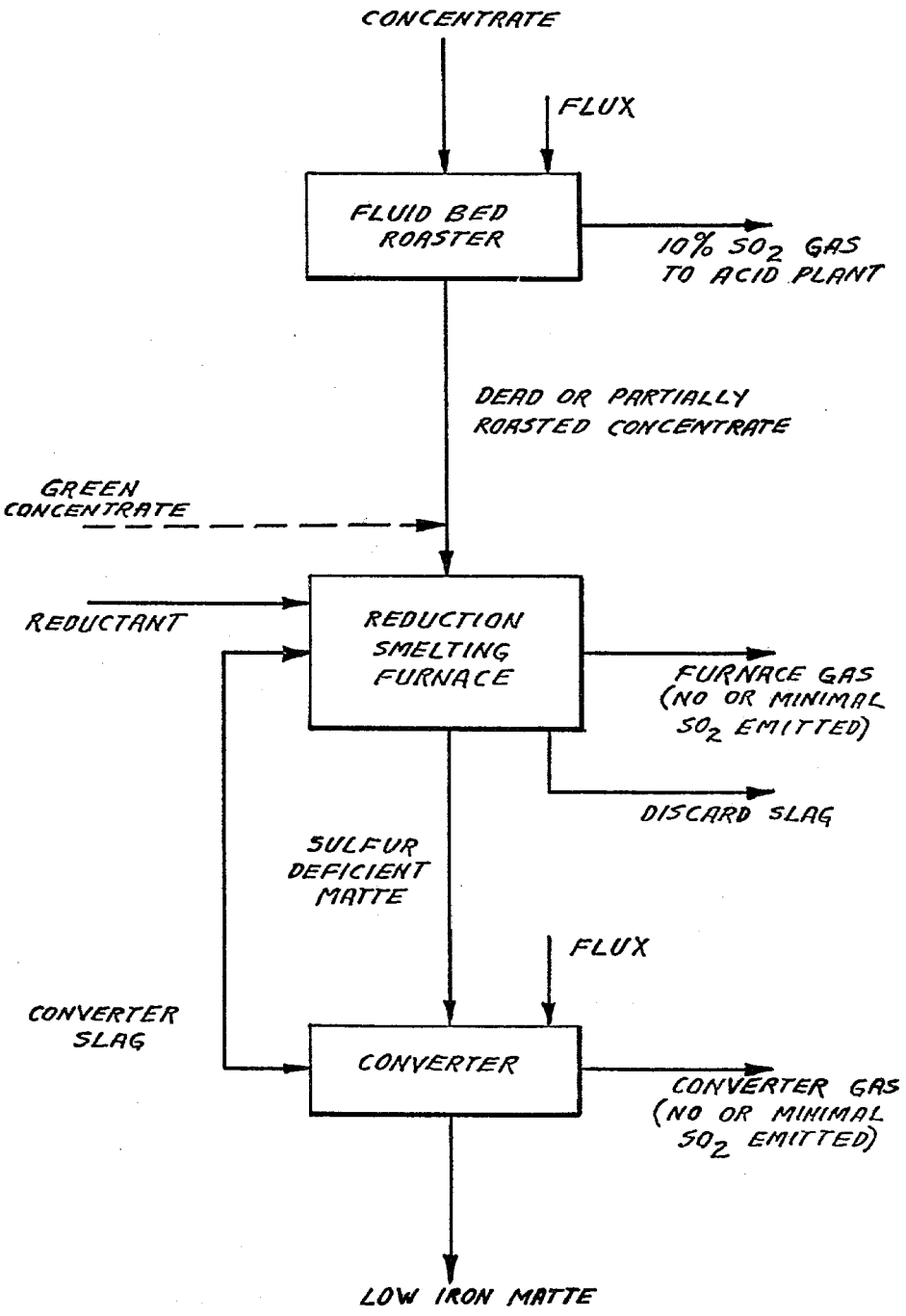
CONCENTRATE
FLUX
FLUID BED ROASTER
10% $SO_2$ GAS TO ACID PLANT
DEAD OR PARTIALLY ROASTED CONCENTRATE
GREEN CONCENTRATE
REDUCTANT
REDUCTION SMELTING FURNACE
FURNACE GAS (NO OR MINIMAL $SO_2$ EMITTED)
DISCARD SLAG
SULFUR DEFICIENT MATTE
FLUX
CONVERTER SLAG
CONVERTER
CONVERTER GAS (NO OR MINIMAL $SO_2$ EMITTED)
LOW IRON MATTE

REDUCTION SMELTING PROCESS

FIELD OF THE INVENTION

The present invention relates to the processing of metal sulfide ores or concentrates, particularly nickel sulfide ores or concentrates, by a pyrometallurgical route which permits a dramatic decrease of stack and fugitive sulfur dioxide emissions and results in a substantial increase in metal recovery.

BACKGROUND OF THE INVENTION

In recent years, it has become increasingly important to reduce or eliminate sulfur dioxide from gases or smoke being introduced into the atmosphere. Recent widespread attention, especially in the United States and Canada, has been directed toward the environmental impact attendant on the sulfur dioxide stack emissions resulting from smelting of mineral ore, such as nickel sulfides.

Both the United States and the Canadian environmental agencies have put limitations on the amounts of sulfur dioxide stack emissions that are allowed from the stacks at mineral ore smelting locations as well as to the fugitive emissions of sulfur dioxide which are permitted into the work environment. These limitations are on a continuously more stringent basis. It is evident from the following discussion that none of the existing processes can meet these regulations without incurring undue capital expenditures.

Pyrometallurgical processing of nickel sulfide concentrates is currently carried out by the following alternative routes: roast-reverb smelting-converting; roast-electric furnace smelting-converting and flash smelt-converting. In the first two alternatives, the furnace matte grade is controlled by the degree of roasting, that is, the amount of sulfur eliminated in the roaster as sulfur dioxide, so as to minimize the amount of converting work required, but without exceeding a matte grade that could result in excessive base metal losses in the discard slag. This approach permits recycling the converter slag to the smelting furnace for recovery of metal values. In the flash smelting-converting route, a much higher oxidation of the concentrate takes place during smelting than in the above combined roast-smelting operations, thus resulting in much higher matte grade. However, the base metal losses in the furnace slag are also considerably higher and, accordingly, this slag, together with the converter slag, has to be processed for metal recovery normally in an electric furnace.

A common feature of the above-mentioned processes is the production in the smelting furnaces of mattes with sulfur contents close to the stoichiometric requirements of the base metals and the iron. Therefore, during the converting stage both iron and sulfur oxidation have to occur in order to obtain the low-iron sulfur-deficient matte which is the usual product of nickel sulfide pyrometallurgical processing.

Substantial evolution of sulfur dioxide occurs in each one of the unit operations comprising these routes, the only exception being electric furnace slag cleaning. Only for fluid bed roasting and flash smelting is the sulfur dioxide contained in a continuous high strength gas, which permits efficient fixation of the sulfur dioxide as sulfuric acid. Reverberatory smelting produces large volumes of gas containing only 1% to 2% $SO_2$. The electric furnace gas volume is usually much smaller, depending on air infiltration, but its sulfur dioxide concentration is still well below the optimum of about 10% that can be taken by modern sulfuric acid plants. Converter gases are normally weak, unless capital intensive tight water-cooled hoods are provided to decrease air infiltration, in which case a gas stream with up to about 6% sulfur dioxide can be delivered to an acid plant. However, because of the batch nature of converting, the volume of this gas stream suffers dramatic fluctuations, and thus metallurgical acid plants require peak capacities far greater than normally used. Converting is also the major source of fugitive emissions into the work environment. Each time that a converter has to be taken off tuyeres for charging or discharging molten materials, substantial amounts of sulfur dioxide are put into the smelter atmosphere. The partial solution of this problem again requires large capital expense in providing double hoods and fans.

Accordingly, the need exists to efficiently, yet simply and without incurring excessive expense, provide a smelting process that permits a drastic reduction in sulfur dioxide emissions up the stack and in the work environment, and at the same time results in improved metal recovery without the need of special slag cleaning facilities. The present invention accomplishes just that end.

OBJECT OF THE INVENTION

The present invention aims at providing a process that produces a single continuous stream of gas that contains practically all the sulfur eliminated in the process as sulfur dioxide in sufficient concentration, about 10% by volume, to permit the fixing of the sulfur dioxide as sulfuric acid.

A further object of the present invention is to provide a process which has low or no fugitive sulfur dioxide emissions into the work environment.

A further object of the present invention is to provide a process whereby improved metal recoveries from nickel containing sulfide ores and concentrates is accomplished.

BRIEF DESCRIPTION OF THE DRAWINGS

The present invention will be more readily understood by reference to the accompanying drawing which depicts a schematic flow diagram of the process of the present invention wherein the roasting, reduction-smelting, and converting stages are shown.

SUMMARY AND DESCRIPTION OF THE INVENTION

According to the process of the present invention extremely high recoveries of metal values, previously unachievable, can be obtained by subjecting a nickel sulfide concentrate to a roast-function smelting-converting route which permits a dramatic decrease in sulfur dioxide stack emissions from smelter gases into the atmosphere, and which achieves a substantially sulfur dioxide gas free work environment without the accompanying problems of the prior art and without the cost connected with the processes of the prior art.

Removal of practically all the sulfur which has to be eliminated from the concentrate as sulfur dioxide is achieved in the roasting stage. The roasting stage may consist of either dead roasting a portion (usually a substantial portion) of the concentrate or partial roasting of all of the concentrate. In either case, more than 85% of the sulfur dioxide produced in the overall bessemer matte production process is eliminated in concentrated form, about 10% sulfur dioxide, via the roaster gas which may thereafter be captured and fixed as sulfuric acid without going up the stack as an emission. Also, in either case, most of the iron in the resulting calcine is present as iron oxides as well as is most or part of the nickel and the cobalt depending on the degree of roasting. Sulfur dioxide emissions are kept to a minimum in the following process stages by charging to the smelting furnace a mixture of the dead roasted concentrate and the remainder of the fresh concentrate or the partially roasted concentrate, with either feed containing only sufficient sulfur to yield a furnace matte in which the iron is present as metallic iron, and which has a sulfur deficiency of about 0% to 25% with respect to base metals. The higher sulfur deficiencies may be desired when precious metals recovery is to be achieved by separating a metallic phase from the converter product. Prior to the reduction-smelting stage the mixture of dead roasted concentrate and fresh concentrate or the partially roasted concentrate is blended with a reducing agent and silica flux. The silica flux may be added advantageously to the roaster to maximize heat recovery in the feed to the electric furnace. The amount of reductant to be added must be sufficient to reduce the nickel, cobalt and copper oxides contained in the furnace feed and also a controlled portion of the iron oxides to metallic iron, which reports to the furnace matte. The silica flux addition must satisfy the slagging requirements of the remainder of the iron oxides. The resulting sulfur-deficient, highly metallized, furnace matte is then converted to a low iron matte. Because this furnace matte is already limited in its sulfur content close to that required for the final converter product, during converting only minimal sulfur is oxidized to sulfur dioxide, thus eliminating the major cause of the fugitive emissions into the work environment encountered in current processing. The converting stage, therefore, results only in the oxidation of iron which is slagged by appropriate flux. The converter slag is recycled to the reduction-smelting furnace where conditions are extremely favorable for high metal recoveries from the slag.

A further significant benefit derived from the process of the present invention, namely, increased metal recovery during smelting, is also realized due to the highly favorable base metal distribution between matte and slag when the matte is sulfur-deficient and the slag is in a reduced state. Thus, base metal losses via the discard slag from smelting are lower than those in any existing smelting process for treating nickel sulfide concentrates. The favorable base metal distribution, in particular that of cobalt, increases with an increasing content of metallic iron in the matte. However, this also results in an increase of the melting point of the matte thus requiring higher operating temperature in the furnace. This mode of operation should present no problem in properly cooled furnaces.

Roasting is preferably carried out in fluid bed roasters because of the favorable reaction rates, high oxygen efficiencies and consequently high strength product gas containing about 10% sulfur dioxide, which allows easy fixation of sulfur dioxide as sulfuric acid. Reduction smelting is preferably conducted in an electric furnace, which facilitates achieving the highly reducing conditions required by the process.

The nickel, iron and sulfur contents of nickel sulfide concentrates are normally within the following respective ranges: 5%-30%, 20%-50% and 20%-40%. The concentrates also contain variable amounts of copper, cobalt, precious metals and other minor elements in addition to mineral oxides such as silica, alumina, etc. As an example, consider a concentrate analyzing about 2.9% Cu, 11.6% Ni, 0.4% Co, 38% Fe and 28% S, the remainder being gangue and minor amounts of precious metals and other elements. According to the invention, this concentrate is either dead roasted and then blended with fresh concentrate or partially roasted to a resulting material having about 5% S which is sufficient to satisfy the sulfur requirement of a converter product which will be further processed to separate three fractions, namely a nickel sulfide concentrate, a copper sulfide concentrate and a metallic fraction containing the precious metals. In either mode of roasting sulfur removal from the concentrate is higher than 90%. In a fluid bed roaster the sulfur dioxide gas produced has sufficient strength, about 10% sulfur dioxide, to be amenable to fixing as sulfuric acid. The calcine or calcine-green concentrate mixture is blended with a carbonaceous reductant, such as coal or coke, but not limited to these, in an amount not to exceed about 10 wt. % and depending upon the degree of reduction desired. Silica flux is also blended in an amount depending on the desired amount of iron to be slagged in smelting. This blend is then reduction-smelted in an electric furnace and yields a matte containing about 45-65 wt. % of copper plus nickel plus cobalt and traces of precious metals. This matte has a sulfur deficiency of about 10-20% with respect to the stoichiometric sulfides $Ni_3S_2$, $Co_9S_8$ and $Cu_2S$, and corresponds to the sulfur to metal ratio desired in the converter product. The matte contains from 20-35 wt. % metallic iron and most of this is removed by oxidation-slagging during converting, during which virtually all of the sulfur in the matte is retained, as described above, thereby eliminating both stack and fugitive sulfur dioxide emissions.

The novelty and utility of the present invention resides in the high sulfur dioxide fixation which can be achieved in a very efficient form as compared to the prior art, because more than 85% of the sulfur dioxide produced in the overall bessemer matte process is eliminated via the fluid bed roaster gas in a continuous stream in concentrated form, about 10% sulfur dioxide.

Another advantage to the present invention is the safety offered the workers around the furnaces and converters in smelting operations. It is evident that with the dramatically reduced amount of sulfur dioxide gases in these areas as compared to the prior art the workers have a much improved and healthier environment in which to perform their tasks.

Additional advantages of the process of the present invention are economics of smelter operation. Smelting furnace matte and converter slag tonnages are much smaller than in conventional reverberatory or electric furnace smelting, thus substantially reducing hot material handling and converting time. No further or additional slag cleaning is required for high cobalt recovery as is needed in the flash smelting route. There is substantial capital savings in that fewer converters are required, fewer number and less complex converter hoods and smaller, less complex acid plants are needed because of a single source, high strength and constant volume gas.

For the purpose of giving those skilled in the art a better understanding of the present invention and/or better appreciation of the advantages of the invention, the following examples are given.

EXAMPLE I

Green nickel concentrates were analyzed and found to have the following weight percent compositions:

| | Cu | Ni | Co | Fe | S | $SiO_2$ |
|---|---|---|---|---|---|---|
| #1 | 1.2 | 10.3 | 0.18 | 27 | 22 | 17 |
| #2 | 3.1 | 12.0 | 0.38 | 38 | 29 | 7.8 |

The moisture content of concentrates #1 and #2 were 12% and 10% respectively.

The concentrates were partially roasted in a fluid bed reactor at a bed temperature of about 800° C. Throughputs were about 31 and 22 tonnes/day per square meter, respectively. The roaster gas and calcine were separated by means of a cyclone and electrostatic precipitator. The combined cyclone and electrostatic precipitator product had the following compositions:

| | Cu | Ni | Co | Fe | S | $SiO_2$ |
|---|---|---|---|---|---|---|
| #1 | 1.3 | 11.3 | 0.20 | 30.3 | 4.3 | 18.0 |
| #2 | 3.3 | 12.9 | 0.42 | 38.9 | 4.1 | 9.0 |

Fluid bed roaster operation was smooth and the roasting rate was controlled solely by the flowrate of air delivered to the roaster grate. The air flowrate was in turn controlled by the space velocity desired in the roaster, which was about 1.6 actual meters per second for both concentrates. Oxygen efficiencies were better than 95%.

EXAMPLE II

Green nickel concentrate was analyzed and found to have the following weight percent composition:

| Cu | Ni | Co | Fe | S | $SiO_2$ |
|---|---|---|---|---|---|
| 2.93 | 11.6 | 0.40 | 38.1 | 28.0 | 6.89 |

The concentrate was dead roasted to various calcines at 800° C. The resulting calcines were analyzed and found to have between 0.5 and 0.7 weight percent sulfur.

Reduction smelting was conducted on blends of calcines and green nickel concentrates with $SiO_2$ flux and coke additives in clay crucibles, with graphite lids which were held at 1250° C. for two hours. The results are summarized in Table I below:

TABLE I

| Conc. Ratio Dead Roasted Green Conc. | Wt.(1) % Coke | Cu | Ni | Co | Fe | S | $SiO_2$ | Relative(2) % Sulfur Def. of Matte |
|---|---|---|---|---|---|---|---|---|
| (1) 4.84 | 5.0 | *12.6 | 49.8 | 1.02 | 15.6 | 19.0 | | 13 |
| | | **0.23 | 0.31 | 0.14 | 39.1 | 0.40 | 39.8 | |
| (2) 4.84 | 5.0 | *12.5 | 47.5 | 1.10 | 15.5 | 18.9 | | 10 |
| | | **0.39 | 0.68 | 0.15 | 36.5 | 0.58 | 42.2 | |
| (3) 4.62 | 6.0 | *11.6 | 43.2 | 1.18 | 23.6 | 16.9 | | 14 |
| | | **0.22 | 0.15 | 0.10 | 35.8 | 0.44 | 38.4 | |
| (4) 4.92 | 6.5 | *10.8 | 42.0 | 1.16 | 28.4 | 15.2 | | 19 |
| | | **0.20 | 0.18 | 0.071 | 38.6 | 0.60 | 41.0 | |
| (5) 5.08 | 7.5 | *10.1 | 38.5 | 1.20 | 33.5 | 13.5 | | 22 |
| | | **0.27 | 0.28 | 0.05 | 34.8 | 0.75 | 43.8 | |
| (6) 4.92 | 8.3 | *8.66 | 35.2 | 1.04 | 40.4 | 12.6 | | 19 |
| | | **0.18 | 0.099 | 0.044 | 37.1 | 0.72 | 37.7 | |

(1)Relative to the dead roasted plus green concentrate weight.
(2)Refers to the deficiency in S for $Cu_2S$, $Ni_3S_2$ and $Co_9S_8$ only.
*Matte
**Slag Sulfur recoveries from the feed to the matte were typically 85% with about 10% recovered in the slag. The matte sulfur deficiencies with respect to Cu+Ni+Co are similar to that of converter product.

The cobalt partitions (percent cobalt in the matte/percent cobalt in the slag) are substantially higher than for any smelting process now known in the art. For example, cobalt partitions in reverberatory smelting processes are about 5. The cobalt partitions of the calcine/green nickel concentrate blend analyzed in Table I above are summarized in Table Ia below. It is to be noted that cobalt partitions increase uniformly with the increasing iron of the matte.

TABLE Ia

| Calcine Blend from Table I above | Matte to Slag Weight Percent Ratio Co in Matte/Co in Slag |
|---|---|
| No. 1 | 7.3 |
| 2 | 7.3 |
| 3 | 12.0 |
| 4 | 16.0 |
| 5 | 24.0 |
| 6 | 24.0 |

EXAMPLE III

Calcines were produced by partially fluid bed roasting nickel concentrates at 800° C. The resulting calcines were analyzed and found to have the following compositions:

TABLE II

| # | Cu | Ni | Co | Fe | S | $SiO_2$ |
|---|---|---|---|---|---|---|
| (1) | 2.80 | 14.1 | 0.38 | 43.7 | 1.24 | 9.10 |
| (2) | 2.97 | 10.4 | 0.34 | 44.5 | 4.17 | 9.95 |
| (3) | 2.86 | 10.5 | 0.35 | 43.5 | 6.99 | 10.7 |

Blends of these partially roasted calcines with and without green concentrate additive, analyzing (wt. %): 2.65 Cu, 9.49 Ni, 0.30 Co, 38.6 Fe, 26.3 S and 9.95 $SiO_2$, were reduction smelted according to the procedure described in Example II, and the results summarized in Table III below:

TABLE III

| Conc. Ratio Calcine 1/ Green Conc. | Wt. %(1) Coke | Cu | Ni | Co | Fe | S | $SiO_2$ | Relative(2) % Sulfur Def. of Matte |
|---|---|---|---|---|---|---|---|---|
| 4.48 | 5.8 | *8.50 | 47.0 | 1.00 | 22.8 | 15.0 | | 24 |

TABLE III-continued

| | Wt. %(1) Coke | Cu | Ni | Co | Fe | S | $SiO_2$ | Relative(2) % Sulfur Def. of Matte |
|---|---|---|---|---|---|---|---|---|
| | | **0.16 | 0.14 | 0.074 | 37.2 | 0.56 | 40.9 | |
| 4.48 | 6.0 | *8.50 | 42.0 | 1.00 | 28.0 | 14.8 | | 18 |
| | | **0.18 | 0.28 | 0.058 | 37.9 | 0.76 | 40.9 | |
| 4.48 | 6.3 | *8.00 | 39.5 | 1.00 | 33.0 | 14.3 | | 16 |
| | | **0.17 | 0.15 | 0.048 | 37.1 | 0.77 | 41.3 | |
| Conc. Ratio Calcine 2/ Calcine 3 | | | | | | | | |
| 4.26 | 5.0 | *12.0 | 42.5 | 1.10 | 24.0 | 16.3 | | 15 |
| | | **0.21 | 0.15 | 0.078 | 37.7 | 0.63 | 38.1 | |
| 4.26 | 5.4 | *10.5 | 40.0 | 1.10 | 28.5 | 14.4 | | 19 |
| | | **0.19 | 0.13 | 0.062 | 38.7 | 0.70 | 39.2 | |
| 4.26 | 5.8 | *11.0 | 36.0 | 1.05 | 32.5 | 14.3 | | 13 |
| | | **0.20 | 0.14 | 0.052 | 38.1 | 0.79 | 39.9 | |

(1)Relative to the dead roasted plus green concentrate weight.
(2)Refers to the deficiency in S for $Cu_2S$, $Ni_3S_2$, and $Co_9S_8$ only.
*Matte
**Slag From the above data it is seen that the objects of the present invention of providing a process which provides improved metal recovery and allows for reduced sulfur dioxide stack emissions during smelting are accomplished.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

The embodiments of the invention, in which an exclusive property or privilege is claimed, are defined as follows:

1. A process for recovering base metal values from sulfide concentrates containing iron sulfide and at least one base metal sulfide value from the group consisting of nickel, copper and cobalt which comprises the successive steps of roasting to provide a calcine of reduced sulfur content and a gas having a sulfur dioxide content permitting fixing of sulfur therefrom as sulfuric acid, reduction smelting of the resulting calcine to a matte containing metallic iron and having a sulfur deficiency with respect to the stoichiometric sulfides $Ni_3S_2$, $Co_9S_8$ and $Cu_2S$ of up to 25%, and then oxidizing and slagging off substantially all of the iron content of the matte with essentially no release of sulfur dioxide during said iron oxidation.

2. The process in accordance with claim 1 wherein substantially all the sulfur contained in said calcine is transferred to said matte formed in said reduction smelting operation.

3. The process in accordance with claim 1 wherein reduction of iron oxides of said calcine in said reduction smelting is accomplished with a carbonaceous reductant.

4. The process in accordance with claim 1 wherein said concentrate fed to said roasting step is essentially dead roasted and the resulting calcine is blended with fresh concentrate to provide a feed of required sulfur content to said reduction smelting operation.

5. The process in accordance with claim 1 wherein said concentrate fed to said roasting step is roasted to a controlled sulfur content.

6. The process in accordance with claim 1 wherein said roasting step is conducted in a fluid bed reactor.

7. The process in accordance with claim 6 wherein silica flux needed to flux iron oxides in said reduction smelting is introduced into said fluid bed reactor to maximize heat recovery in the feed to said reduction smelting operation.

8. The process in accordance with claim 1 wherein at least about 85% of the sulfur in said concentrate feed is removed in said roasting operation as a gas stream from which sulfur dioxide can be economically fixed.

9. The process in accordance with claim 1 wherein the sulfide concentrate treated is a nickel concentrate.

* * * * *